United States Patent [19]

Cameron

[11] Patent Number: 4,520,337

[45] Date of Patent: May 28, 1985

[54] BORIC ACID EXPULSION FUSE

[75] Inventor: Frank L. Cameron, North Huntingdon, Pa.

[73] Assignee: Westinghouse Electric Corp., Pittsburgh, Pa.

[21] Appl. No.: 633,813

[22] Filed: Jul. 23, 1984

[51] Int. Cl.[3] ..... H01H 85/38

[52] U.S. Cl. ..... 337/275; 337/273

[58] Field of Search ..... 337/273, 274, 275, 279, 337/281, 221, 291

[56] References Cited

U.S. PATENT DOCUMENTS 3,855,563 12/1974 Cameron et al. ..... 337/291

*Primary Examiner*—Harold Broome

*Attorney, Agent, or Firm*—L. P. Johns

[57] ABSTRACT

A high voltage circuit interrupter characterized by a tubular insulating casing that encloses a tube of boric acid forming an elongated bore. The bore includes bore portions of smaller and larger diameter. An elongated conductor is disposed in the bore and forms a clearance space therewith. Fusible means extend between the enlarged conductor and a fuse terminal. Upon fusion of the fusible means the larger end portion of the conductor is retracted into the smaller bore portion while maintaining a clearance space therewith, so that a minimal clearance space between the smaller bore portion and the enlarged end portion of the conductor provides adequately high water vapor pressure to extinguish an electric arc generated by fusion of the fusible means.

6 Claims, 2 Drawing Figures

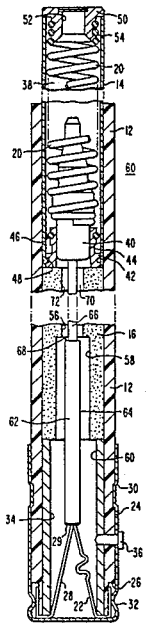

MISSING PAGE TEMPORARY NOTICE

PATENT # 4520337 FOR ISSUE DATE 5-28-85

HAS BEEN SCANNED, BUT WITH MISSING PAGE(S). UPON RECEIVING OF MISSING PAGE(S), THE ENTIRE DOCUMENT WILL RE RESCANNED. PLEASE CALL IMAGE DATA ADMINISTRATION STAFF OF 557-6154 IF YOU HAVE A QUESTION. ASK FOR DAVE GROOMS, ANITA YOUNG OR POLA JONES.

THIS NOTICE IS FOR THE MISSING PAGE CONTAINING:

DRAWING SHEET # 1

MISSING PAGE TEMPORARY NOTICE

PATENT # 4520337 FOR ISSUE DATE 5-28-85

HAS BEEN SCANNED, BUT WITH MISSING PAGE(S). UPON RECEIVING OF MISSING PAGE(S), THE ENTIRE DOCUMENT WILL RE RESCANNED. PLEASE CALL IMAGE DATA ADMINISTRATION STAFF OF 557-6154 IF YOU HAVE A QUESTION. ASK FOR DAVE GROOMS, ANITA YOUNG OR POLA JONES.

THIS NOTICE IS FOR THE MISSING PAGE CONTAINING:

DRAWING SHEET # 2

BORIC ACID EXPULSION FUSE

BACKGROUND OF THE INVENTION

1. Field of the Invention

This invention relates to circuit breakers and, more particularly, it pertains to a high capacity expulsion fuse.

2. Description of the Prior Art

Circuit interrupters, such as boric acid fuses for high voltage operation above about 15 kV, comprise a tube of gas evolving, arc-extinguishing material, such as boric acid, through which a movable contact rod extends. One end of the rod is retained against a spring by a fusible wire. In order to be a full range interrupting device, that is, one which can interrupt the full range of fault currents from minimum melting to maximum interrupting rating, certain minimum clearance parameters must be maintained between the rod and the surrounding boric acid tube. The minimal clearance is required during the interruption of low currents on the order of from one to 800 amperes. The minimal clearance is needed so that an adequate pressure is generated during interruption of these relatively low currents. If the clearance exceeds the required parameters, the required dielectric strength of the interrupting medium, during arcing, is not realized nor is the ionic disassociation which results from a high pressure gas blast effective.

The minimal clearances, however, have caused problems when water seeps into the fuse. Ordinary current carrying operation of a fuse at elevated temperatures can cause a transfer of water vapor and migration of dissolved boric acid which affect the required clearances. The migration of boric acid has been found to cause an actual physical interference between the contact rod and the boric acid inner diameter, resulting in the contact rod becoming "frozen" in place, whereby the fuse rod is unable to retract during a fault interruption operation. Without physical withdrawal of the contact rod, the fuse fails to interrupt and destructs.

SUMMARY OF THE INVENTION

It has been found in accordance with this invention that the foregoing problem may be overcome by providing a high voltage circuit interrupter comprising tubular means of insulating material capable of providing a gas evolving, arc-extinguishing gas when in proximity to an electric arc; the tubular means including an arc passage having one end portion larger than the other end portion; terminal means at each end of the tubular means; a conductor within the passage and having one end portion larger than the other end portion and forming a clearance space with the walls forming the passage; the conductor being connected to the terminal at one end of the tubular means; fusible means extending between the terminal means at the other end of the tubular means and the conductor; moving means at one end of the conductor for moving the conductor in the direction of the smaller end portion upon fusion of the fusible means.

The advantage of the circuit interrupter of this invention is that a minimum clearance is maintained between a movable contact rod and boric acid so that an adequate gas pressure is generated during high voltage-low current interruptions.

BRIEF DESCRIPTION OF THE DRAWINGS

FIG. 1 is a vertical sectional view of a boric acid expulsion fuse of prior art contruction; and FIG. 2 is a vertical sectional view of a boric acid expulsion fuse in accordance with this invention.

DESCRIPTION OF THE PREFERRED EMBODIMENT

An expulsion fuse is generally indicated at 10 in FIG. 1 and discloses the prior art fuse structure as shown more particularly in U.S. Pat. No. 3,855,563. Generally, the fuse comprises a tubular insulating casing 12, a tubular conducting casing 14, a body 16 of arc-extinguishing material such as boric acid, a conductor or contact rod 18, biasing means such as a helical tension spring 20, and fusible means such as a fuse element 22.

The tubular insulating casing 12 is composed of a suitable insulating material, such as a filament wound glass epoxy, and is provided at one end with a ferrule 24 which is composed of a metal, such as copper. The ferrule 24 has an inturned flange portion covering the lower end of the casing 12 and encloses an annular notch for reduced portion 26 in which outer ends of the fuse element 22 and a strain link 28 are secured by the ferrule. The tubular conducting casing 14 and the ferrule 24 serve as electrically conductive terminals at opposite ends of the fuse.

The ferrule 24 is secured in place by peripheral grooves 30, 32 which are formed by suitable metal deforming methods, such as rolling, or preferably by the magnetic forming method, as described in U.S. Pat. No. 3,333,336 issued Aug. 1, 1967. Thus, the form-fitting ferrule 24 is secured on the end of the casing 12 and it retains the ends of the fuse element 22 and strain link 28 in place, the other end being retained in the elongated conducting member by weld 29. A tubular conductor 34 is disposed within the lower open end portion of the casing 12. A locating pin 36 is seated in aligned apertures in the casing 12 and the tubular conductor 34, which pin serves a primary purpose of locating the fuse pin in place within a mounting means (not shown) and also provides a current path to tubular conductor 34 during interruption.

The conducting casing 14 is an elongated member composed of a metal having good electrical conductivity such as copper. The lower end portion of the casing 14 is snugly fitted within the upper end portion of the casing 12 and has a purpose of providing a chamber 38 in which the helical spring 20 is disposed and into which the rod 18 is retracted by the spring when the fuse element 22 melts or fuses under an excess current. In the circuit closed position of the contact rod, the upper end portion, which includes an enlarged head 40, is seated within an annular conductor 42. The conductor 42 comprises a plurality of spaced fingers 44 extending upwardly from the body of the conductor, and an annular coil spring 46 holds the fingers in good electrical contact with the enlarged head 40 of the rod 18. The annular conductor 42 includes a peripheral groove 48 in which an in-turned annular end portion of the casing 14 is seated in a form-fitted manner, such as by Magneforming.

The upper end of the conducting casing 14 includes an end cap 50 having a central bore 52. The upper end portion of the helical spring 20 is secured at 54 to the outer surface of the end cap 50 and assembly of the end cap and spring is in turn secured in place within the casing 14 by a form-fitted joint. Thus, the assembly of the end cap 50, the spring 20, and the casing 14 are secured together without the use of additional fastening means.

The body 16 of arc-extinguishing material is an elongated tubular member disposed between the annular conductor 42 and the tubular conductor 34. The upper end portion 56 of the bore of the body has a smaller diameter than the lower portion 58 which in turn has a smaller diameter bore of the conductor 34. This construction facilitates extinguishment of an arc of both low and high current densities which occur when the helical tension spring 20 retracts the rod 18 from the closed circuit position as shown in the drawing. The preferred composition of the body 16 is boric acid from which emanates water vapor and other arc destroying vapors and which creates a turbulent, high pressure deionizing enviroment when exposed to an arc.

The fuse element 22 is preferably composed of a material, such as silver, having a high coefficient of electrical conductivity. However, the strain link 28, having a primary purpose of retaining the rod 18 in the lowermost closed circuit position, is composed of a material having a relatively high coefficient of electrical conductivity and high strength, such as a nickel-chronium alloy. Accordingly, when a current overload of sufficient magnitude passes through the fuse 10, the fuse element 22 is fused and the current selects the ultimate route through the strain link 28 of higher electrical resistance, melting the strain element, and thereby relieving the retaining force on the rod 18 and permitting the spring 20 to retract the rod to the upper, open circuit position.

The success of fuses utilizing boric acid and its easily recondensible, evolved water vapor is dependent upon the fact that boric acid, upon being heated, yields water as follows:

ORTHO Boric Acid META Boric Acid Boron Oxide $$2H_3BO_3 \xrightarrow{100^\circ\ C.} 2HBO_2 + 2H_2O \xrightarrow{>150^\circ\ C.} B_2O_3 + H_2O$$

The effecting interrupting ability of boric acid is a result of the water vapor released by the heat of the electric arc during a short circuit interruption. The boric acid goes from ORTHO boric acid to META boric acid as it loses moisture. The high pressure water vapor causes the arc to be extinguished and causes the boric acid to be oblated. Ordinary current carrying operation of the fuse at elevated temperatures can cause a transfer of water vapor and migration of dissolved boric acid such that the necessary clearances are affected. Such migration of the boric acid has been found to cause an actual physical interference to occur between the contact rod and the boric acid inner diameter. In such instances the "movable" contact rod becomes "frozen" in the tightly confining boric acid so that the fuse rod is unable to retract during a fault interruption operation. Without physical withdrawal of the contact rod, the fuse fails to interrupt and destructs.

In accordance with this invention, an expulsion fuse 60 (FIG. 2) satisfies the problems of the fuse 10 disclosed is FIG. 1. In FIG. 2 similar numerals refer to similar parts and the fuse 60 differs from the fuse 10 in the following particulars. The fuse 60 comprises a contact rod 62 which includes an enlarged portion 64 as well as a reduced portion 66, which portions are demarked at a shoulder 68.

As a result of the reduced portion 66, a greater clearance space 70 exists between the reduced portion 66 and the wall 72 of the bore through which the rod extends. However, the enlarged rod portion 64 has a diameter less than that of the diameter of the bore wall 72 so that when a current overload occurs sufficient to melt the fuse element 22, the rod 62 is freed to retract upwardly through the bore without interference from any bore shrinkage due to reduction of the bore circumference as described with regard to the prior embodiment of FIG. 1.

As shown in FIG. 2, the tubular structure of the boric acid body 16 and the rod 62 are well separated during the static condition. Thus, a minor growth of the boric acid surface or wall 72 does not cause an impingement upon and resulting binding together of the rod 62 and the wall, as previously described, due to the entry of water and the attendant boric acid migration. Shortly after the rod 62 begins to move, the entrace of the enlarged rod portion 64 creates the desired minimum clearance for effective pressure generation in the lower portion of the fuse. Any migration of boric acid which has previously occured would not retard the rod movement once it is in motion. The inertia of the moving rod readily overcomes any increased frictional forces due to the boric acid buildup.

Accordingly, the fuse of this invention eliminates a source of field trouble which has in the past been substantial. For maximum current rating designs, an adjustment of boric acid and rod parameters is necessary as the full cross-sectional area of the contact rod is required for full load current-carrying operation. At all lesser ratings of the fuel line, however, the device is readily implemented by simply "stepping down" (shoulder 68) a portion of the upper length of the contact rod.

What is claimed is:

1. A high voltage circuit interrupter comprising:

(a) tubular means of insulating material capable of providing an arc-extinguishing gas when in proximity to an electric arc;

(b) the tubular means including an arc passage having one end portion larger than the other end portion;

(c) terminal means at each end of the tubular means;

(d) a conductor within the passage and having one end portion larger than the other end portion and forming a clearance space with the walls forming the passage;

(e) the conductor being connected to the terminal at one end of the tubular means;

(f) fusible means extending between the terminal means at the other end of the tubular means and the conductor; and (g) moving means at one end of the conductor for moving the conductor in the direction of the smaller end portion upon fusion of the fusible means.

2. The interrupter of claim 1 in which the passage includes an enlarged portion at the end adjacent to the fussible means.

3. The interrupter of claim 1 in which the conductor is axially movable within the passage and the larger end portion is adjacent to the fusible means.

4. The interrupter of claim 3 in which the cross-sectional area of the larger end portion of the conductor is less than that of the smaller end portion of the passage.

5. The interrupter of claim 4 in which the smaller and larger end portions of the passage are cylindrical.

6. The interrupter of claim 5 in which the larger end portion of the conductor is retractable into the smaller end portion of the passage upon fusion of the fusible means, and in which the clearance space between the conductor and passage wall is maintained upon such retraction.

* * * * *